US008437681B2

(12) United States Patent
Winter et al.

(10) Patent No.: US 8,437,681 B2
(45) Date of Patent: May 7, 2013

(54) PRINTER OR COPIER FOR PRINTING AN ENDLESS SUPPORT MATERIAL COMPRISING TRANSVERSAL FOLDS, AND METHOD FOR CONTROLLING SUCH A PRINTER OR COPIER

(75) Inventors: Hans Winter, München (DE); Günther Gassner, Mühldorf (DE)

(73) Assignee: OcéPrinting Systems GmbH, Poing (DE)

( * ) Notice: Subject to any disclaimer, the term of this patent is extended or adjusted under 35 U.S.C. 154(b) by 1579 days.

(21) Appl. No.: 11/629,637

(22) PCT Filed: Jun. 17, 2005

(86) PCT No.: PCT/EP2005/006559

§ 371 (c)(1),
(2), (4) Date: Nov. 9, 2007

(87) PCT Pub. No.: WO2005/124470

PCT Pub. Date: Dec. 29, 2005

(65) Prior Publication Data

US 2012/0039619 A1 Feb. 16, 2012

(30) Foreign Application Priority Data

Jun. 21, 2004 (DE) ..... 10 2004 029 943

(51) Int. Cl.

| | |
|---|---|
| ***G03G 15/00*** | (2006.01) |
| ***B41J 11/00*** | (2006.01) |
| ***B41L 3/02*** | (2006.01) |

(52) U.S. Cl.

USPC ..... 399/384; 399/387; 399/394; 101/486; 400/583; 400/613.2

(58) Field of Classification Search ..... 399/384, 399/387, 394; 101/485, 486; 400/579, 583, 400/613.2

See application file for complete search history.

(56) References Cited

U.S. PATENT DOCUMENTS

| | | | | |
|---|---|---|---|---|
| 4,924,266 | A | 5/1990 | Negoro et al. | |
| 4,949,104 | A | 8/1990 | Negoro et al. | |
| 6,305,857 | B1 * | 10/2001 | Crowley et al. | 400/579 |
| 6,370,351 | B1 * | 4/2002 | Puritscher et al. | 399/313 |

FOREIGN PATENT DOCUMENTS

| | | |
|---|---|---|
| DE | 38 17 130 | 12/1988 |
| DE | 38 24 108 | 1/1989 |
| EP | 0 223 405 | 5/1987 |
| EP | 0 390 750 | 10/1990 |
| EP | 1 028 355 | 8/2000 |
| EP | 0 857 322 | 1/2001 |
| GB | 2 188 618 | 10/1987 |

(Continued)

*Primary Examiner* — Matthew G Marini
(74) *Attorney, Agent, or Firm* — Schiff Hardin LLP

(57) ABSTRACT

In a method or system for controlling a printer or copier, a separation of a position mark printed on a web-shaped carrier material in a longitudinal direction of the carrier material relative to a transverse fold present in the carrier material is preset as a parameter. Arrival of the position mark is monitored with a sensor arrangement arranged before a transfer printing area while the carrier material is moved past the sensor arrangement. A real position of the transverse fold is determined for a position of arrival of the position mark at the sensor arrangement. The transverse fold is conveyed to a desired position by consideration of the real position of the transverse fold.

8 Claims, 15 Drawing Sheets

FOREIGN PATENT DOCUMENTS

| | | |
|---|---|---|
| JP | 03 129374 | 6/1991 |
| JP | 04 292963 | 10/1992 |
| WO | WO 97/16767 | 5/1997 |
| WO | WO 99/24262 | 5/1999 |

* cited by examiner

PRINTER OR COPIER FOR PRINTING AN ENDLESS SUPPORT MATERIAL COMPRISING TRANSVERSAL FOLDS, AND METHOD FOR CONTROLLING SUCH A PRINTER OR COPIER

BACKGROUND

The preferred embodiment concerns a printer or copier in which transverse folds formed in an endless carrier material are aligned on a position marking. The preferred embodiment also concerns a method for controlling such a printer or copier as well as a sensor arrangement for determination of the position of the transverse fold relative to an adjacent margin hole of an endless carrier material provided with margin holes.

In known high-capacity printers, in particular in electrophotographic high-capacity printers with a printing capacity of ≧50 sheets DIN A 4 per minute, an exact positioning of the print image on the carrier material to be printed is important in order to enable a simple further processing of the printed carrier material and a high print quality of printer products produced with this printed carrier material. Given printing of endless carrier material with transverse folds provided in the carrier material, in particular the position of the print image relative to the transverse fold is thereby decisive. Upon insertion of the endless carrier material into the printer, a transverse fold is thereby directed towards a position marking. Due to this alignment and parameters of the carrier material preset in the printer, which parameters in particular comprise the interval between two transverse folds, the positions of further transverse folds in the printer or copier are known to a control unit of the printer.

A portion of the typically-used endless carrier materials is provided with margin holes that are arranged at a fixed spacing relative to one another. Another portion of the carrier materials typically used comprises printed markings. Both the margin holes and the printed markings can be detected by the printer or copier with suitable sensor arrangements. The bearing of the endless carrier material in the printer or copier can be continuously monitored and checked with the aid of the detected positions. The positions of further transverse folds present in the carrier material relative to the margin holes or to the printed markings are also known via the preset parameters of the carrier material.

Given carrier material with margin holes, a margin hole tolerance of ±2 mm at 2 m is typical, whereby given a typical spacing of 1 m between a hole sensor and fold marking a fold deviation of ±1 mm results. It is also assumed that a setting precision of ±1 mm is present given alignment of the transverse fold on the fold marking. Because the printer or copier is also kept in operation, a further deviation of ±1 mm is assumed that in particular is dependent on the bearing of the carrier material in the printer, the tension of the carrier material upon transport in the printer or copier, the thickness of the carrier material, the surface of the carrier material as well as on the positioning of the hole sensor. A possible total deviation of the real margin hole position by ±3 mm thereby results relative to the desired margin hole position at a hole detection sensor arranged, for example, after a rotating frame.

In particular given a spacing of the transverse folds of 11 and 4/6 inches and a hole interval of ½ an inch, the three successive folds have different bearings relative to the adjacent margin holes. Given alignment of a fold marking and association of a hole spaced with a fixed hole count, an incorrect evaluation of the bearing of the transverse fold relative to the adjacent hole can occur as a consequence of these possible deviations of ±3 mm, whereby the transverse fold can also be associated with a different margin hole than the adjacent one, which different margin hole is not a margin hole adjacent to the transverse fold. The spacing between two folds is also designated as a form length. The described problems occur given all form lengths of N and 1/6 inches, N and 2/6 inches, N and 4/6 inches and N and 5/6 inches, whereby N is a whole-number value.

SUMMARY

It is an object to specify a method for controlling a printer or copier as well as a printer or copier given which an exact positioning of print images relative to transverse folds present in an endless carrier material is ensured in a simple manner.

In a method or system for controlling a printer or copier, a separation of a position mark printed on a web-shaped carrier material in a longitudinal direction of the carrier material relative to a transverse fold present in the carrier material is preset as a parameter. Arrival of the position mark is monitored with a sensor arrangement arranged before a transfer printing area while the carrier material is moved past the sensor arrangement. A real position of the transverse fold is determined for a position of arrival of the position mark at the sensor arrangement. The transverse fold is conveyed to a desired position by consideration of the real position of the transverse fold.

DESCRIPTION OF THE PREFERRED EMBODIMENT

Figure 1:
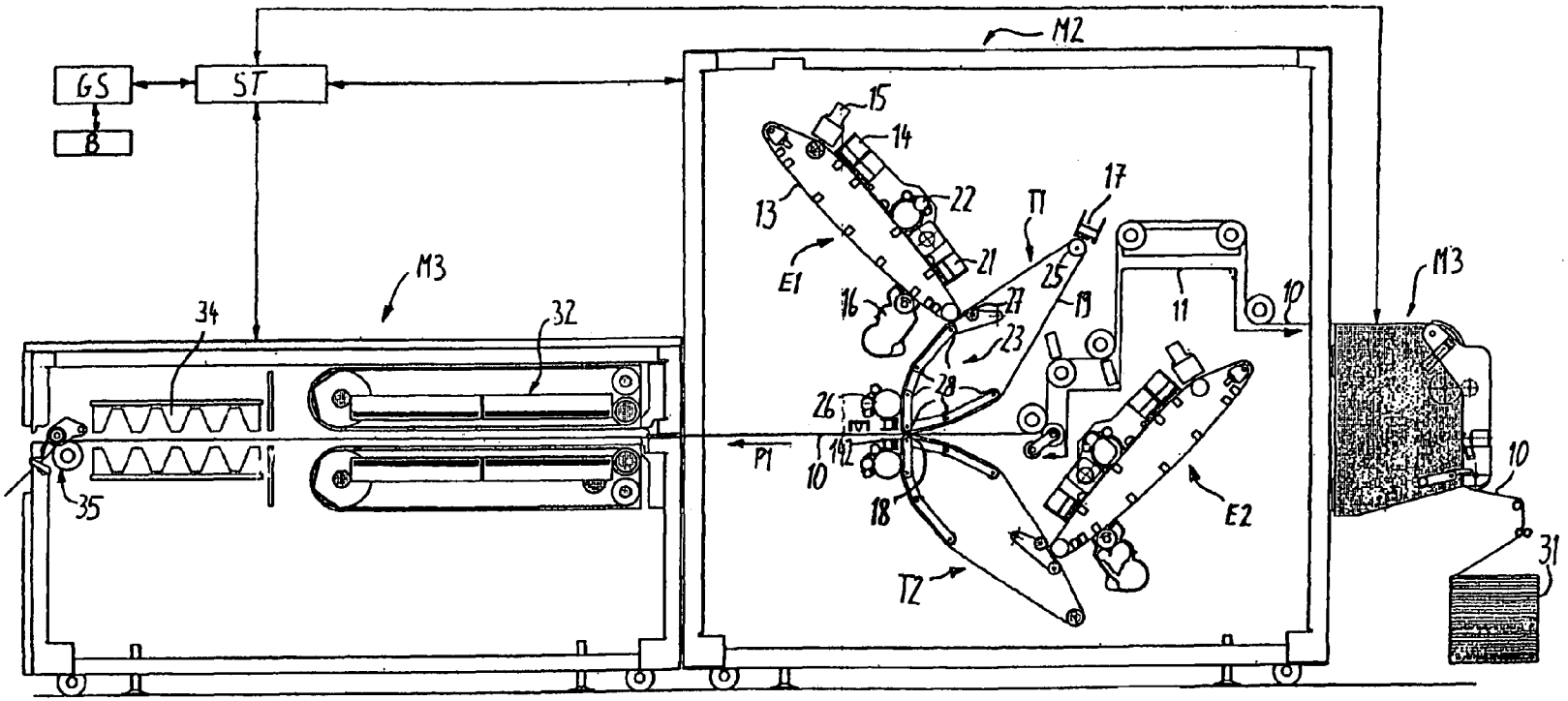
FIG. 1 is a schematic representation of a high-capacity printer according to the present preferred embodiment.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

In particular in that the position of a first transverse fold aligned on a position marking is determined relative to an adjacent first margin hole of an endless margin-less carrier material, the bearing of the transverse fold relative to the margin hole is in particular clearly determined under consideration of the parameters of the carrier material. Thus the occurrence of a second margin hole at the sensor arrangement is monitored with the aid of a sensor arrangement arranged near the transfer printing point. The bearing of the second transverse fold in the printer or copier can thereby be determined exactly.

A false association of holes adjacent to the first or second transverse fold due to the imprecise knowledge of the bearing of the first transverse fold relative to the adjacent margin hole and the incorrect association of adjacent margin holes occurring upon alignment of the transverse fold on the position marking, the carrier material tolerances and the apparatus tolerances of the printer or copier is avoided simply and effectively. This false association of margin holes adjacent to the transverse fold is also designated as a ⅙ inch jump. Such a jump leads to an unusable print result since all print images on the carrier material are arranged displaced by ⅙ of an inch. This problem is effectively avoided in the preferred embodiment.

A second aspect of the preferred embodiment concerns a method for controlling a printer or copier. The points in time of the arrival of at least two margin holes arranged at an interval in succession in the longitudinal direction of the carrier material 10 upon passage of the carrier material by the sensor arrangement is detected with the aid of a sensor arrangement. The real interval between the two margin holes is determined. The real interval is also compared with such an interval. The position of a first transverse fold aligned on a position marking is also determined relative to an adjacent first margin hole. The position of a second transverse fold present in proximity to a transfer printing point in the carrier material is determined. A second margin hole arranged at a preset first interval relative to this second transverse fold is determined. The arrival of the second margin hole at the sensor arrangement is monitored with the aid of a sensor arrangement. The to-be-expected position deviation of the real position from the desired position of the second transverse fold is determined and corrected dependent on the comparison result and on the distance between the sensor arrangement and the desired position of the second transverse fold.

Via this method it is achieved that in particular positioning errors of a print image on the carrier material are prevented via the determination and correction of the actual present length tolerance.

A third aspect of the preferred embodiment concerns a printer or copier with a first sensor arrangement for determination of the position of a first transverse fold relative to an adjacent first margin hole of a carrier material provided with continuous margin holes, whereby the first transverse fold is aligned on a position marking. The printer or copier has a control unit that determines the position of a second transverse fold present in proximity to the transfer printing point in the carrier material and the position of second margin hole arranged at a preset interval relative to this second transverse fold. The printer or copier also has a second sensor arrangement arranged in proximity to the transfer printing point, which second sensor arrangement monitors the arrival of the second margin hole at the sensor arrangement while the carrier material is directed past the second sensor arrangement.

Given such an electrophotographic printer or copier it is possible to position a transverse fold in an exact desired position in proximity to the transfer printing point, such that a print image is generated exactly at the desired position on the carrier material. An incorrect positioning, in particular due to what is known as a ⅙ inch jump, is effectively avoided in a simple manner in such a printer or copier of the preferred embodiment.

A fourth aspect of the preferred embodiment concerns a printer or copier with a first sensor arrangement that, given direction of the carrier material past the sensor arrangement, detects the points in time of the arrival of at least two margin holes arranged at an interval in succession in the longitudinal direction of an endless carrier material. The printer or copier also has a control unit that, with the aid of the transport speed, determines the real interval between the two margin holes and compares the real interval with a desired interval. A second sensor arrangement is also provided for determination of the position of a first transverse fold with an adjacent first margin hole, whereby the first transverse fold is aligned on a position marking. The control unit determines the position of a second transverse fold present in proximity to the transfer printing point. The control unit also determines a second margin hole arranged at a preset interval relative to this second transverse fold. The second sensor arrangement monitors the arrival of the second margin hole at the sensor arrangement. Dependent on the comparison result and on the distance between the sensor arrangement and a desired position of the second transverse fold, the control unit determines the to-be-expected position deviation of the real position of the second transverse fold from the desired position of the second transverse fold.

In this printer or copier a positioning error of a print image to be printed on the carrier material is avoided in a simple manner.

A fifth aspect of the preferred embodiment concerns a method for controlling a printer or copier in which the points in time of at least two margin holes are arranged at an interval in succession are detected with the aid of a sensor arrangement upon direction of the carrier material past a sensor arrangement during the transport of the carrier material. The actual interval between the two margin holes is determined with the aid of the known transport speed. The determined interval is compared with a desired interval, whereby an interval correction value is determined.

Via this method it is achieved that positioning errors of print images on the carrier material as a result of allowable length tolerances of employed carrier materials (in particular of paper webs) are avoided in a simple manner. This method can be implemented continuously and/or after the insertion of a new charge carrier material or of a new paper roll or of a new stack of continuous paper.

A sixth aspect of the preferred embodiment concerns a printer or copier with a sensor arrangement that detects the points in time of at least two margin holes arranged at an interval in succession given direction of the carrier material past the sensor arrangement during the transport of the carrier material. This printer or copier has a control unit that determines the interval between the two margin holes with the aid of the transport speed. The control unit also compares the determined interval with a desired interval. The control unit thereby determines an interval correction value.

With the aid of such a printer it is possible in a simple manner to exactly position print images on a carrier material since positioning errors as a consequence of allowable length tolerances of the carrier material are avoided. In particular print images can thereby be aligned exactly relative to transverse folds of the carrier material, whereby print products can be produced with high quality.

A seventh aspect of the preferred embodiment concerns a method for controlling a printer or copier in which the separation of one position mark printed on an endless carrier material is preset as a parameter in the longitudinal direction of the carrier material relative to a transverse fold present in the carrier material. The arrival of the position mark at the sensor arrangement is monitored with the aid of a sensor arrangement arranged in proximity to the transfer printing point while the carrier material is directed past the sensor arrangement. The real position of the transverse fold is determined for the position of the arrival of the position mark at the sensor arrangement. The transverse fold is conveyed to a desired position under consideration of the real position. It is thereby achieved that, in a relatively simple manner, the transverse fold can be aligned relatively precisely on a desired position in proximity to the transfer printing point, whereby exactly positioned print images can be generated on the carrier material.

An eighth aspect of the preferred embodiment concerns a method for controlling a printer or copier. The points in time of the arrival of at least two position marks successively arranged at an interval in the longitudinal direction of the carrier material are determined with the aid of a sensor arrangement given direction of the carrier material past the sensor arrangement. The real interval between the position marks is determined and compared with a desired interval. The spacing in the longitudinal direction of the carrier material of a position mark printed on the carrier material relative to a transverse fold present in the carrier material is preset as a parameter. The arrival of the position mark at the sensor arrangement is monitored with the aid of the sensor arrangement while the carrier material is directed past the sensor arrangement. The real position is determined and corrected dependent on the comparison result and on the distance between the sensor arrangement and a desired position of the transverse fold.

Via this method for controlling a printer or copier it is achieved that positioning errors are detected and corrected, whereby correctly-positioned print images are generated on the carrier material.

A ninth aspect of the preferred embodiment concerns a printer or copier with a control unit in which the position of a position mark printed on an endless carrier material relative to a transverse fold present in this carrier material can be stored as a parameter. The printer or copier has a sensor arrangement arranged in proximity to the transfer printing point, which sensor arrangement monitors the arrival of the position marker upon passage of the carrier material past the sensor arrangement. The control unit determines the real position of the transverse fold with the aid of the determined position of the position mark and controls the printer or copier such that it conveys the transverse fold from the real position up to a desired position.

With the aid of such an electrophotographic printer or copier it is possible in a simple manner to position the transverse fold exactly in or at a desired position and to generate subsequent print images in a predetermined position on this carrier material.

A tenth aspect of the preferred embodiment concerns a printer or copier with a sensor arrangement that detects the points in time of the arrival of at least two position marks printed on the carrier material, which position marks are arranged in succession at an interval in the longitudinal direction of the endless carrier material. The printer or copier also has a control unit that determines the real interval between the two position marks with the aid of the transport speed and compares the real interval with a desired interval. The positions of a position mark printed on the endless carrier material relative to a transverse fold present in this carrier material can be stored in the control unit as a parameter. The sensor arrangement monitors the arrival of the position mark upon direction of the carrier material past the sensor arrangement. The control unit determines the real position of the transverse fold with the aid of the determined position of the position mark. Dependent on the comparison result and on the distance between the sensor arrangement and a desired position of the transverse fold, the control unit determines and corrects the to-be-expected position deviation of the real position of the transverse fold from the desired position of the transverse fold.

This printer or copier of the preferred embodiment determines the longitudinal deviation and corrects the position deviation of the print image resulting from the longitudinal deviation.

An eleventh aspect of the preferred embodiment concerns an arrangement for determination of the position of a transverse fold present in an endless carrier material provided with margin punching. This arrangement has a position marking on which the transverse fold can be positioned. The arrangement also has a sensor arrangement that comprises at least two sensors that, viewed in the transport direction of the carrier material, are arranged essentially one after another at an interval relative to the position marking, which interval can be preset. Each sensor also detects a margin hole present in its detection region.

Via such an arrangement it is achieved that the position of the transverse fold positioned at the position marking can be determined exactly relative to the adjacent margin holes. The determined position of the transverse fold can then be utilized in a simple manner to exactly determine the positions of other transverse folds in the printer or copier and to position individual transverse folds at desired positions in the printer or copier.

A twelfth aspect of the preferred embodiment concerns a method for determination of the position of a transverse fold present in an endless carrier material provided with margin punching. The transverse fold is positioned at a position marking. The position of at least one margin hole is detected with the aid of a sensor arrangement comprising two sensors, whereby the sensors are arranged essentially one after another at an interval in the transport direction of the carrier material, which interval can be preset. A margin hole present within its detection region is detected by each sensor.

Via this method it is possible to exactly determine the position relative to the adjacent margin holes of a transverse fold aligned on the position marking and thus to exactly determine the position of further transverse folds in the carrier material. Individual transverse folds in the printer or copier can thereby be aligned exactly in a simple manner.

A transverse fold in the sense of the preferred embodiment can be dashed or solid line printed on the carrier material and/or a perforation contained in the carrier material or introduced in the carrier material. Alternatively, the transverse fold can also be a virtual transverse fold that is not visible in the carrier material and, for example, is a processing edge provided in the post-processing. The protective scope of the invention of the patent claims is thus not limited to only physical transverse folds introduced in or on the carrier material.

A high-capacity printer that is designed in a modular fashion is schematically shown in FIG. 1. The printer comprises a feed module M1, a print module M2 and a fixing module M3. Each module comprises a plurality of physical units, of which at least a portion can be taken out and/or extracted from the printer in a simple manner for service and maintenance tasks as well as for cleaning tasks.

The feed module M1 holds the endless carrier material 10 (comprising a paper web) under a constant tension both in continuous operation and in start-stop operation, such that this endless carrier material 10 does not tear in the different operating states as well as given an change between the operating states and can be continuously supplied to the print module M2.

The print module M2 comprises aggregates required for the printing of a band-shaped carrier material 10 with toner images. The carrier material 10 provided from the feed module M1 is transported via a transport channel 11 through the print module M2 towards the fixing module M3. A first electrophotography module E1 is arranged above the transport channel or the band-shaped recording medium 10 and a second electrophotography module E2 is arranged below the transport channel or the band-shaped recording medium 10. Transfer modules T1, T2 are respectively associated with the electrophotography modules E1, E2. The first electrophotography module E1 and the first transfer module T1 form a first upper printing group and the second electrophotography module E2 and the second transfer module T2 form a second lower printing group. The upper printing group with the modules E1 and T1 is provided for generation of toner images on the front side of the carrier material 10 and the lower printing group with the modules E2 and T2 is provided for generation of toner images on the back side of the carrier material 10. The electrophotographic modules E1 and E2 as well as the toner materials T1 and T2 are respectively essentially designed identically and mirror-symmetrically with regard to the carrier material 10. The electrophotography modules E1, E2 respectively comprise a photoconductor belt 13 directed over deflection rollers 12 and driven in an electromotorized manner, in particular an organic photoconductor (OPC).

The electrophotography modules E1 and E2 also respectively comprise a corotron unit 14 for charging of the photoconductor belt 13, a character generator 15, a developer station 16, a discharge corotron 21 as well as a cleaning station 22. The transfer module T1 additionally comprises a recharging corotron 17 that recharges the toner particles of the toner image transferred from the photoconductor belt 13 onto a transfer belt 19 of the transfer module T1 such that the toner particles have a desired charge state upon transfer onto the carrier material 10. The toner image located on the photoconductor belt 14 is transferred from the photoconductor belt 13 onto the transfer belt 19 in the region of a transfer printing roller 18. The transfer of the toner image from the photoconductor belt 13 onto the transfer belt 19 is abetted by the potential difference between the transfer roller 18 and the transfer belt 19.

The transfer belt 19 is directed over a plurality of rollers 25, 27, 28, of which at least one roller is driven in an electromotorized manner and serves as a drive roller for the transfer belt 19. The roller arrangement 25, 27, 28 is thereby designed such that the transfer belt 19 can be pivoted onto the carrier material 10 and be pivoted away from this again in a transfer printing region 143. This pivot function is realized with the aid of a pivot arrangement that is designated with 23, whereby a plurality of rollers (respectively designated with 28) are connected with one another via pivotable levers. This pivot arrangement in particular serves in the start-stop operation to generate toner images with different toner colors on the photoconductor belt 13 in succession with the aid of further developer stations (not shown) and to individually transfer the toner images onto the transfer belt 19. The toner images generated in succession in the different toner colors are transferred in register with one another onto the transfer belt 19 and thereby collected on the transfer belt.

The toner images collected in series on the transfer belt 19 are subsequently transferred onto the carrier material 10, whereby before the transfer the transfer belt 19 was pivoted (with the aid of the lever mechanism 23) with the rollers 28 towards the carrier material 10 accelerated to transport speed.

For cleaning of the transfer belt 19 after the transfer printing of the toner images, a cleaning station 26 is respectively provided towards which the transfer belt 19 is pivoted with the aid of the lever mechanism 23 given pivoting of the transfer belt 19 onto the recording medium 10 in order to remove toner residues still remaining on the transfer belt 19. After the transfer printing of the toner images onto the carrier material 10, these are further directed to the fixing module M2 that respectively comprises an infrared fixing unit 32 for fixing of the front side and the back side of the carrier material 10. The carrier material 10 is subsequently directed past cooling elements 34 before it is transported (with the aid of the roller pair 35) from the module M3 to further processing (not shown).

The control units of the individual modules M1, M2 and M3 are respectively connected with a central control device ST of the printer. The central control unit ST is connected with a device controller GS of the printer that in particular administers print jobs and activates a control panel B. Individual components of the printer are described in detail in the international patent application WO 98/39691. The content of this patent application is herewith incorporated by reference into the present specification.

The printer according to FIG. 1 can process as a recording medium 10 an endless paper web with or without margin punching. Such endless paper webs typically have a transverse fold that can be designed as a perforation. Such a perforation serves for the simple separation of the paper webs into segments after the printing. The printer positions the paper web to be printed such that a print image to be generated on the paper web is arranged at a preset interval from the transverse fold after the transfer printing. In particular print images in register can thereby be generated. The arrow P1 indicates the primary transport direction of the carrier material 10 in the printing.

Figure 2:
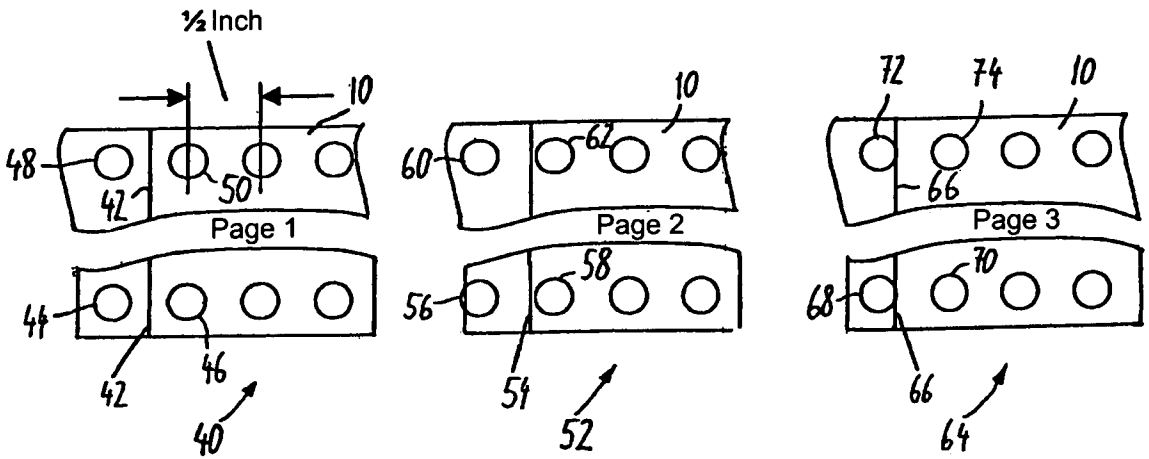
FIG. 2 is a schematic representation of sections of an endless carrier material with margin punching and transverse fold in an example of print pages with a form length of 11 and 4/6 inches.

Three segments 40, 52, 64 of an endless paper web 10 are shown in FIG. 2; the position of the transverse folds 42, 54, 66 of three successive pages comprised in the paper web 12 with regard to the margin holes adjacent to the transverse folds 42, 54, 66 in the paper web 10 is shown. Identical elements have the same reference characters. The length of each of these segments 40, 52, 64 amounts to 11 and 4/6 inches; the interval between two adjacent margin holes amounts to ½ an inch. In the first segment 40 the bearing of a first transverse fold 42 that is arranged transverse to the endless paper web 10. Margin holes are provided on both sides of the paper web 10.

On the one side of the paper web 10 the margin holes designated with 44 and 46 are adjacent to the transverse fold 42 and on the other side of the paper web 10 the margin holes designated with 48 and 50 are adjacent to the transverse fold 42. The transverse fold 42 is arranged in the middle between the margin holes 44 and 46 or 48 and 50. The segments 40, 52, 64 coincide with the page length of respectively one print page, whereby the segment 40 comprises the print page 1, the segment 52 comprises the print page 2 and the segment 64 comprises the print page 3. Due to the page length of 11 and 4/6 inches, the subsequent transverse fold 54 at the end of the page 1 or before the page 2 is displaced opposite to the primary transport direction P1 by 22 margin holes and 4/6 of an inch, as shown in segment 52. The transverse fold between the page 1 and the page 2 is designated with 54.

The holes adjacent to the transverse fold 54 are designated with 56, 58 as well as 60, 62. Unlike the transverse fold 42, the transverse fold 54 is not arranged in the middle between two adjacent margin holes 56, 56 or 60, 62, but rather is displaced by 4/6 of an inch in the direction of the margin holes 62, 58 and thus is arranged close to these margin holes 58, 62. In segment 64 the bearing of the transverse fold 66 is shown between the second page and the third page. The fold 66 has a distance of 11 and 4/6 inches from the transverse fold 54 and is thus arranged 22 margin holes plus 4/6 of an inch removed from the transverse fold 54. Due to the displacement by the distance of 4/6 of an inch a further margin hole is skipped, such that the transverse fold 66 is arranged immediately after the 23rd hole after the transverse fold 54. The margin holes adjacent to the transverse fold 66 in segment 64 are designated with 68 and 70 as well as 72 and 74. Given a page length of 11 and 4/6 inches and a hole interval of ½ an inch, three possible positions of the transverse fold with regard to the adjacent margin holes thus result.

Figure 3:
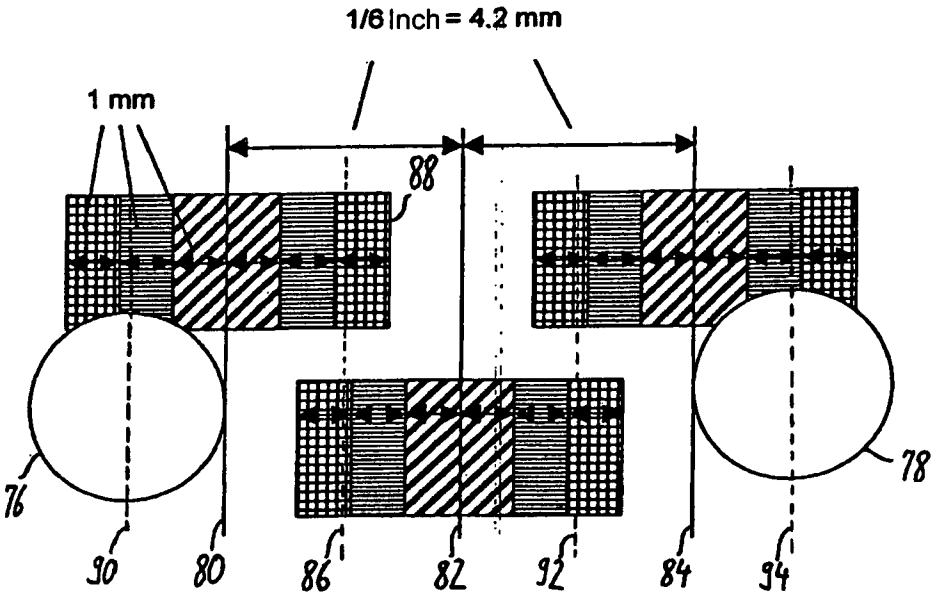
FIG. 3 shows two adjacent margin holes with three possible positions of a transverse fold between these two adjacent margin holes with possible positioning errors.

Two adjacent margin holes 76, 78 are shown in FIG. 3, whereby three possible positions of the transverse fold 80, 82, 84 are shown. The bearing of the transverse fold 80 relative to the margin holes 76 and 78 coincides with the bearing of the transverse fold 66 relative to the margin holes 68 and 70. The central bearing of the transverse fold 82 relative to the margin holes 76 and 78 coincides with the central bearing of the transverse fold 72 relative to the margin holes 44 and 46 according to FIG. 2. The bearing of the transverse fold 84 relative to the margin holes 76 and 78 also coincides with the bearing of the transverse fold 85 relative to the margin holes 56 and 58.

Upon placement of the paper web 10 into the printer according to FIG. 1, a transverse fold is aligned on a position marking. This position marking is advantageously a type of pivotable straight edge that is pivoted from above onto the paper web 10. An operating personnel controls the printer via the control panel B such that the paper web 10 is transported with low speed or with small steps until the transverse fold lies directly on the straight edge edge. Given this adjustment method an adjustment precision of ±1 mm is to be assumed. This range of the deviation of the adjustment precision of ±1 mm is represented by the regions in FIG. 3 hatched with slanted lines.

Conventional endless paper webs with margin punching typically have a length tolerance of ±2 m at 2000 mm paper web length. In the high-capacity printer according to FIG. 1, the interval between the straight edge and a hole sensor for detection of the margin holes amounts to 1000 mm. A further deviation of ±1 mm thus results on this length, whereby the fold aligned on the straight edge in turn has a position deviation of ±1 mm relative to the margin hole detected as next by the hole sensor.

This allowable longitudinal tolerance of the paper web 10 is represented in FIG. 3 by the regions hatched with horizontal lines. Due to the effects of the printer on the inserted paper web 10 (in particular due to the bearing of the paper web 10 in the printer), the tensile stress that the printer exerts on the paper web 10 and the paper properties of the paper web 10 (in particular the thickness and the surface of the paper web 10) as well as the bearing and alignment tolerance of the hole sensor relative to the fold marking lead to a further tolerance of ±1 mm that in the following is also designated as an apparatus tolerance. The range of this deviation is hatched in FIG. 3 with horizontal and vertical lines.

In a disadvantageous case, these deviations overlap such that an overall deviation of ±3 mm can occur in the determination of the position of the fold between two margin holes, as shown by the hatched regions in FIG. 3. It is thereby clear that the tolerance regions of the individual folds 80, 82 and 84 intersect, whereby the bearing or the position of the transverse folds 80, 82 and 84 relative to the adjacent margin holes 76 and 78 can no longer be clearly be kept separate. If the decision threshold is placed at the position of the dashed line 86 and a position deviation of −3 mm occurs upon detection of the position of the transverse fold 80, such that the position of the transverse fold 80 is detected with the aid of the hole sensor at the point designated with 88, the bearing of the transverse fold 80 would be detected as central between the margin holes 76 and 78 (and thus incorrectly). Further decision thresholds are shown with dashed lines that are designated with 90, 86, 92 and 94.

If the transverse fold 80 has a position deviation of >−1.8 mm, the position of the transverse fold 80 is assumed to be to the left of the margin hole 76. Given a deviation of the detected position of the transverse fold 84 by >+1.84 mm it is likewise assumed that the position of the transverse fold 84 lies to the right near the margin hole 78 according to FIG. 3. The position of each transverse fold 80, 82, 84 can thus be incorrectly detected, whereby in particular what is known as a ⅙ inch jump can occur with the transverse fold 80 and 84 when the position of the transverse fold 80 or 84 is determined on the other side of the margin hole 76 or 78.

The positions of further transverse folds in the printer are calculated starting from the detected position. However, due to the incorrect detection of the position of the transverse fold 80, 82, 84 aligned on the straight edge edge the positions of all calculated transverse folds are therefore incorrect. All subsequently-generated print images on the endless carrier web 10 are then printed displaced from a desired position by this incorrectly-calculated value. Jumps of ⅙ of an inch can occur due to the intersections of the tolerance regions and the incorrect association (possibly resulting from this) of the position of a transverse fold (aligned on the straight edge) relative to a subsequent hole detected with the aid of the hole sensor, whereby (as already described) every subsequent print image generated on the paper web 10 is displaced by ⅙ of an inch relative to the transverse folds.

Figure 4:
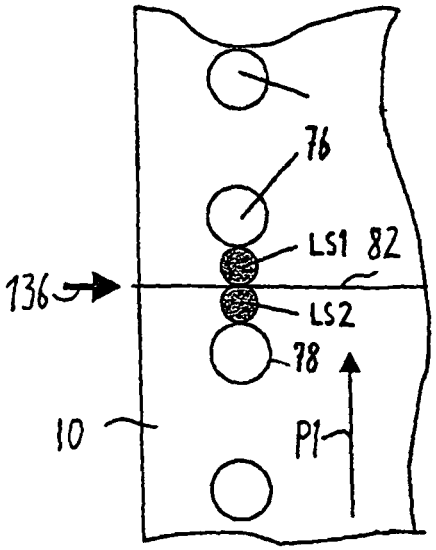
FIG. 4 is a schematic representation of a carrier material arranged in a first position relative to the sensor arrangement.
Figure 5:
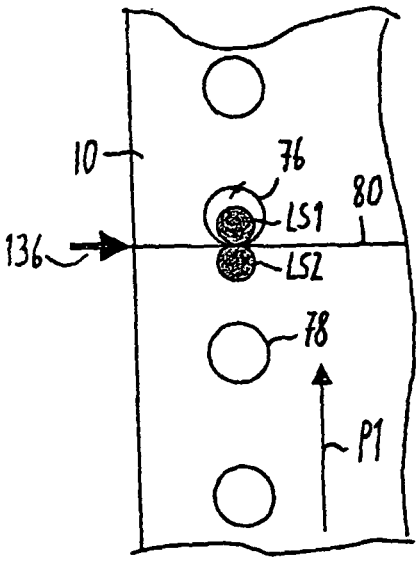
FIG. 5 is a schematic representation according to FIG. 4, whereby the carrier material is arranged in a second position relative to the sensor arrangement.
Figure 6:
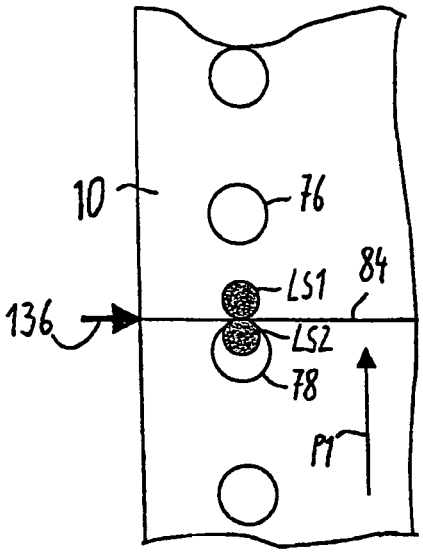
FIG. 6 is a schematic representation according to FIGS. 4 and 5, whereby the carrier material has a third position with regard to the sensor arrangement.

In FIGS. 4 through 6 the detection of the position of the transverse folds 80, 82, 84 relative to the adjacent margin holes 76 and 78 according to FIG. 3 is shown with the aid of a sensor arrangement of the preferred embodiment. For reasons of simplicity, the margin holes adjacent to a transverse fold in FIGS. 4 through 6 are likewise designated with 76 and 78, as in FIG. 3. The sensor arrangement comprises two light barriers LS1, LS2, whereby a light-emitting element is arranged over the paper web 10 and a light-receiving component of each light barrier is arranged below the paper web 10. The light barriers LS1 and LS2 are arranged in the track of the left margin holes of the paper web 10 in the transport direction of the paper web 10. The detection region of each light barrier LS1, LS2 amounts in the transport direction to approximately the length of half of the intervening space between two adjacent margin holes 76, 78. The detection regions of the light barriers LS1 and LS2 advantageously adjoin one another. In the present exemplary embodiment the detection regions of the light barriers LS1 and LS2 are circular and are represented as circles in FIGS. 4 through 6.

The light barriers LS1 and LS2 are arranged on the edge of the straight edge in the region of the margin holes. The alignment edge of the straight edge is located next to this sensor region and is set back so far that the straight edge edge lies approximately in the center of the detection regions of the light barriers LS1 and LS2 in the transport direction of the paper web 10.

Only the allowable adjustment precision upon alignment of the transverse fold 82 on the straight edge is thereby to be taken into account in the position determination of the transverse fold 82 with the aid of the light barriers LS1 and LS2. With the aid of the sensor arrangement shown in FIG. 4, the position of the transverse fold 82 can thus be determined relatively simply with the light barriers LS1 and LS2 without a plurality of overlapping possible position errors having to be taken into account in the evaluation.

Neither the light barrier LS1 nor the light barrier LS2 has a margin hole 76, 78 in its detection region, such that both light barriers LS1, LS2 output a first signal. The control unit ST that evaluates the light barrier signals thereupon determines that the transverse fold 82 is arranged in the middle between the margin holes 76 and 78.

In FIG. 5 the transverse fold 80 between two successive print pages is shown. The transverse fold 80 is (in the transport direction) the transverse fold arranged in the paper web 10 subsequent to the transverse fold 82 according to FIG. 4. Given a form length of 11 and ⅘ inches, the margin hole 76 according to FIG. 5 has a separation of at least 23 margin holes on the endless paper web 10 relative to the margin hole designated in FIG. 4 with 76. The transverse fold 80 is arranged in the proximity of the hole edge of the margin hole 76. The transverse fold 80 is also aligned on the straight edge (which serves as a fold marking) in the same manner as described in connection with FIG. 4. The light emitted from the light barrier LS1 passes through the margin hole 76 in this position and strikes the receiver component of the light barrier LS1. The light barrier LS1 emits a second signal.

The light-emitting component of the light barrier LS2 is arranged over the closed paper web 10 such that the light emitted from the light barrier LS2 does not strike the receiver component arranged below the paper web. The light barrier LS2 thereby emits the first signal. The signals emitted by the light barriers LS1, LS2 are evaluated by the control unit ST, whereby the control unit ST determines the position of the transverse fold 80 in the proximity of the margin hole 76 based on the second signal emitted by the first light barrier LS1 and based on the first signal emitted by the second light barrier LS2.

In FIG. 6 the position of the transverse fold 84 according to FIG. 3 relative to the adjacent margin holes 76 and 78 is shown. The transverse fold 84 has been aligned on the edge of a straight edge provided for alignment and positioning of the transverse fold 84 in the same manner as is shown in connection with FIGS. 4 and 5. For alignment, an operating personnel has manually moved the paper web 10 such that the transverse fold 84 comes to lie exactly under the straight edge edge. A maximum position deviation of ±1 mm is thereby to be assumed.

The light barriers LS1 and LS2 are used for determination of the position of the transverse fold 84 in the same manner as already described in connection with FIGS. 4 and 5. The transverse fold 84 is arranged immediately before the margin hole 78 in the endless paper web 10. No margin hole is located between the light-emitting unit and light-receiving unit of the light barrier LS1, such that the light radiated from the light-emitting unit does not strike the light entrance surface of the receiver. The light barrier LS1 thus emits the first signal.

The margin hole 78 is located in the detection region of the light barrier LS2, such that the light emitted by the emitter unit of the light barrier LS2 strikes the light entrance surface of the light receiver unit of the light barrier LS2. The light barrier LS2 emits the second signal. The control unit ST evaluates the signals of the light barriers LS1 and LS2 and determines that the transverse fold 84 borders on the margin hole 78.

However, the alignment of the transverse fold on the straight edge edge that is described in connection with FIGS. 4 through 6 is only implemented for one of the transverse folds 80, 82, 84. The positions of all other transverse folds present in the endless paper web 10 are then calculated based on the page length known in the printer, i.e. based on the known interval between two transverse folds. The positioning on an arbitrary transverse fold present in the endless paper web 10 then occurs via a hole sensor that advantageously detects the position of one of the margin holes 76, 78 adjacent to the transverse fold 80, 82, 84. The paper web 10 is subsequently transported further with a constant transport speed for a predetermined time span in order to position the transverse fold exactly at a desired position in the printer. This time span is dependent on the separation of the transverse fold 80, 82, 84 from the determined margin hole 76, 78. The smallest transport time of the transverse fold 80 adjacent to the margin hole 76, a medium transport time for positioning of the transverse fold 82 situated in the middle between the margin holes 76, 78, and the longest transport time for positioning of the transverse fold 84 adjoining the margin hole 78 thus result.

In the present exemplary embodiment the different intervals of the transverse fold 80, 82, 84 relative to the adjacent margin holes 76, 78 result due to the page length of 11 and ⅘ inches. Given a page length of 11 and ⅘ inches, the three possible positions of the transverse fold 80, 82, 84 between the adjacent margin holes 76, 78 result due to the standardization of the paper web 10. Other intervals of the transverse folds 80, 82, 84 relative to adjacent margin holes 76, 78 can result given other page lengths and other paper standards.

Figure 7:
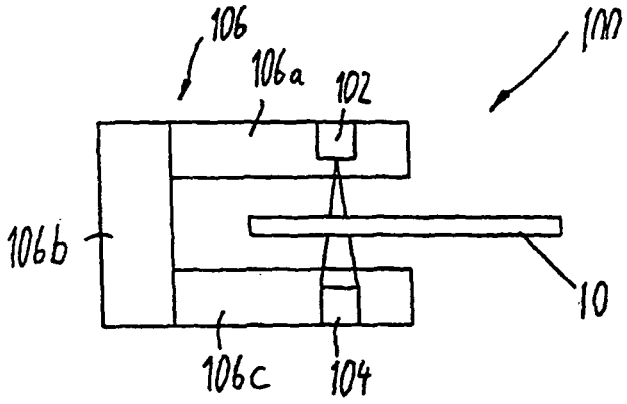
FIG. 7 is a side view of a sensor arrangement according to a first embodiment.

A section representation of a sensor arrangement 100 for determination of the position of the transverse fold 80, 82, 84 according to FIGS. 4 through 6 is shown in FIG. 7. The sensor arrangement 100 has a light-emitting unit 102 that is arranged above the paper web 10 and a light-receiving unit 104 that is arranged below the paper web 10, opposite the light-emitting unit 102. If no paper web 10 or a margin hole 76, 78 is located between the light-emitting unit 102 and the light-receiving unit 104, the light emitted from the light-emitting unit 102 thus strikes the light entrance surface of the light-receiving unit 104. The light-emitting unit 102 and the light-receiving unit 104 form the light barrier LS1.

Given incidence of the light emitted from the light-emitting unit 102 on the light entrance surface of the light-receiving unit 104, the light barrier LS1 emits the first signal. The light-emitting unit 102 and the light-receiving unit 104 are connected with a u-shaped mount 106 that comprises three segments 106A, 106B and 106C. The light-emitting unit and the light-receiving unit of the light barrier LS2 are also arranged in this mount 106, whereby the light barriers LS1 and LS2 are arranged one after another in the direction of paper feed.

Figure 8:
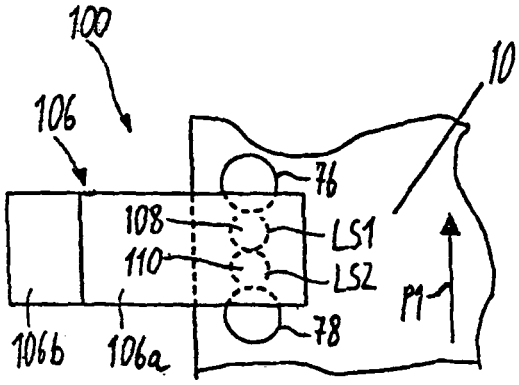
FIG. 8 is a plan view of the sensor arrangement according to FIG. 7.

A plan view of the sensor arrangement 100 according to FIG. 7 is shown in FIG. 8. The detection regions of the light barriers LS1 and LS2 are represented by dashed circles 108, 110.

No margin hole 76, 78 is arranged within the detection regions of the light barriers LS1 and LS2, such that both the light barrier LS1 and the light barrier LS2 output the first sensor signal. As described in connection with FIGS. 3 through 6, the transverse fold is thus located in the middle between the margin holes 76, 78, like the transverse fold 82 shown in FIG. 3.

Figure 9:
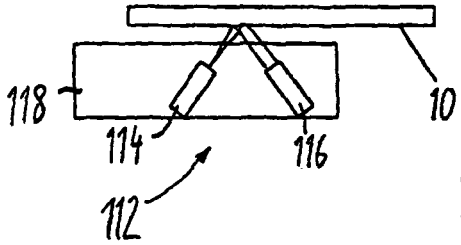
FIG. 9 is a side view of a sensor arrangement according to a second embodiment.

A section representation of an alternative sensor arrangement 112 is shown in FIG. 9. The sensor arrangement 112 according to FIG. 9 comprises a light-emitting unit 113 and a light-receiving unit 116. If the closed paper web 10 is located above the sensor arrangement 112, the light radiated from the light-emitting unit 114 is reflected by the paper web 10, whereby the light-emitting unit 114 and the light-receiving unit 116 are aligned such that the light reflecting on the surface of the paper web 10 strikes the light entrance surface of the light-receiving unit 116.

If a margin hole 76, 78 is located in the paper web 10 at the point at which the light emitted from the light-emitting unit 114 intersects the paper web plane, the light emitted from the light-emitting unit 114 passes through the margin hole 76, 78 and does not strike the light entrance surface of the light-emitting unit 116. The light-emitting unit 114 and the light-receiving unit 116 form a first light sensor LT1.

The light sensor LT1 emits a first signal when the light emitted from the light-emitting unit 114 is reflected by the paper web 10 and is supplied to the light-receiving unit 116. Otherwise the light sensor LT1 outputs a second sensor signal with the light emitted by the light-emitting unit 114 not reflected by the paper web 10 (i.e. in the case in which a margin hole 76, 78 is arranged in a reflection region of the paper web 10 above the sensor arrangement 112) or when no paper web 10 is inserted into the printer. The light-emitting unit 114 and the light-receiving unit 116 are arranged in a carrier 118.

Figure 10:
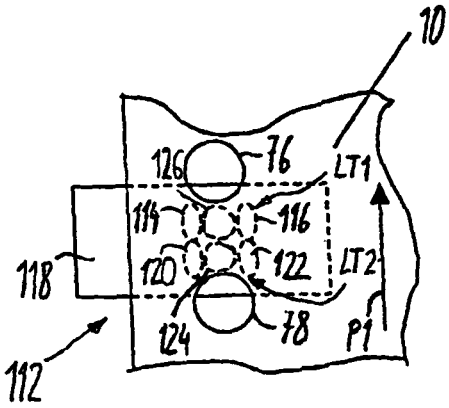
FIG. 10 is a plan view of the arrangement according to FIG. 9.

A plan view of the paper web 10 is shown in FIG. 10, whereby the sensor arrangement 112 is arranged below the paper web 10. A second light sensor LT2 with a light-emitting unit 120 and a light-receiving unit 122 is arranged in the transport direction P1 of the paper web 10 in the same manner as with the light sensor LT1. In FIG. 10 the detection region of the light sensor LT1 is designated with 124 and the detection region of the light sensor LT2 is designated with 126.

Figure 11:
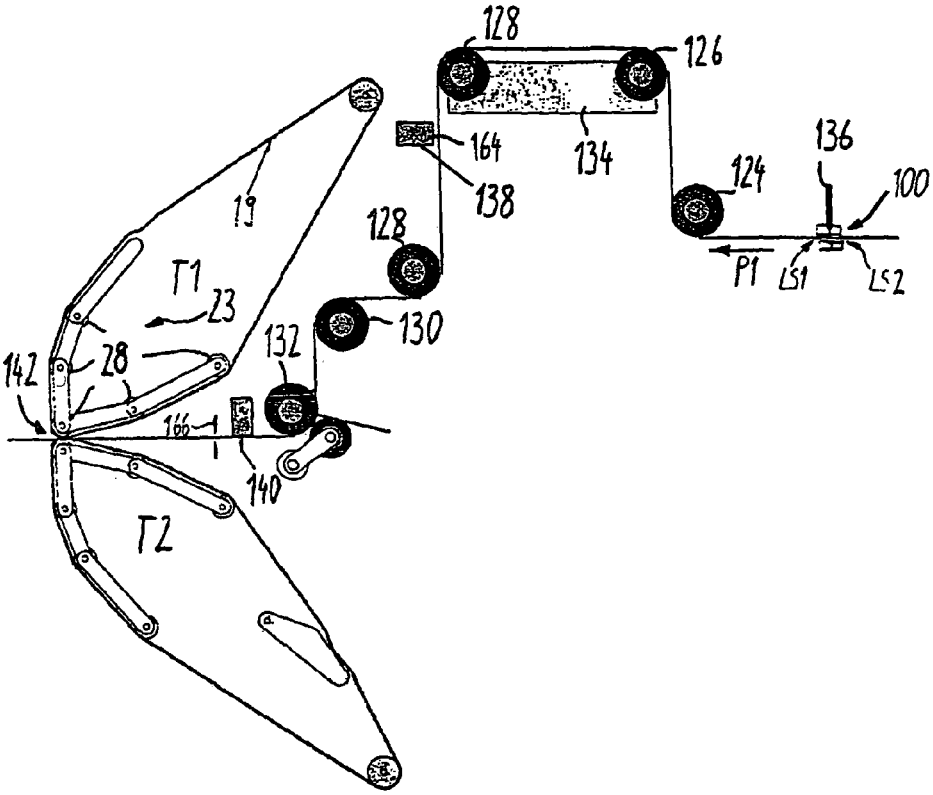
FIG. 11 is a schematic representation of the paper path in the printer according to FIG. 1 for printing of carrier material with margin punching.

Elements of an arrangement for paper direction of the paper web 10 through the printer according to FIG. 1 are shown in FIG. 11. The paper web 10 is directed via deflection rollers 124 through 132, whereby the rollers 126 and 128 are arranged in what is known as a rotating frame that can be pivoted or tilted transverse to the transport direction of the paper web, whereby the pivot axis of the rotating frame 134 is arranged approximately parallel to and below the longitudinal axis of the paper web 10. The arrangement also comprises the sensor arrangement 100 shown in FIGS. 7 and 8 for determination of the position of the transverse fold, whereby the transverse fold is aligned on the edge of the straight edge 136. The arrangement according to FIG. 11 also comprises an edge sensor 164 that detects the lateral position of the margin holes contained in the paper web 10, whereby the slope of the rotating frame 134 and therewith of the rollers 126, 128 is controlled dependent on the position detected with the aid of the edge sensor 164. A regulation of the lateral position of the paper web 10 occurs via the feedback of the sensor signal of the edge sensor 164. This regulation is also designated as edge regulation.

The arrangement also comprises a hole sensor 140 that is arranged in proximity to the transfer printing point 142. Before the start of the transfer printing process of toner images located on the photoconductor belt 19 onto the paper web 10, a transverse fold located before the transfer printing point 142 is positioned at the desired position (designated with 166) 8 inches before the transfer printing point 142 with the aid of the hole sensor 140. The transverse fold that is positioned at this position is advantageously located after an already-printed print page and before a print page to be printed. The arrangement additionally comprises a hole sensor 138 that is arranged in a component with the edge sensor 164.

With the aid of the hole sensor 140 a margin hole 76, 78 in proximity to the transverse fold to be positioned is calculated and a margin hole 76, 78 adjacent to this transverse fold is advantageously determined. Starting from the determined margin hole, the real position of the transverse fold is calculated and compared with a desired position. The distance between desired position and real position is subsequently calculated. The transport time that is required (given a predetermined transport speed) in order to transport the transverse fold from the real position to the wanted desired position is determined under consideration of acceleration ramps for acceleration and braking of the paper web 10. the paper web 10 is transported in the determined transverse fold for the determined transport time such that the transverse fold is transported into the wanted desired position 166. The sensor arrangement 100 with the light barriers LS1 and LS2 is arranged on the straight edge 136, whereby the light-emitting units of the light barriers LS1 and LS2 are arranged above the paper web 10 and the light-receiving units are arranged below the paper web 10.

In other printers only the hole sensor 138 or the hole sensor 140 is provided, whereby according to the invention a first method for controlling the printer with the aid of the hole sensor 138 is provided in which the hole sensor 140 is not required and a second method for controlling the printer with the aid of the hole sensor 140 is provided in which the hole sensor 138 is not required.

Figure 12:
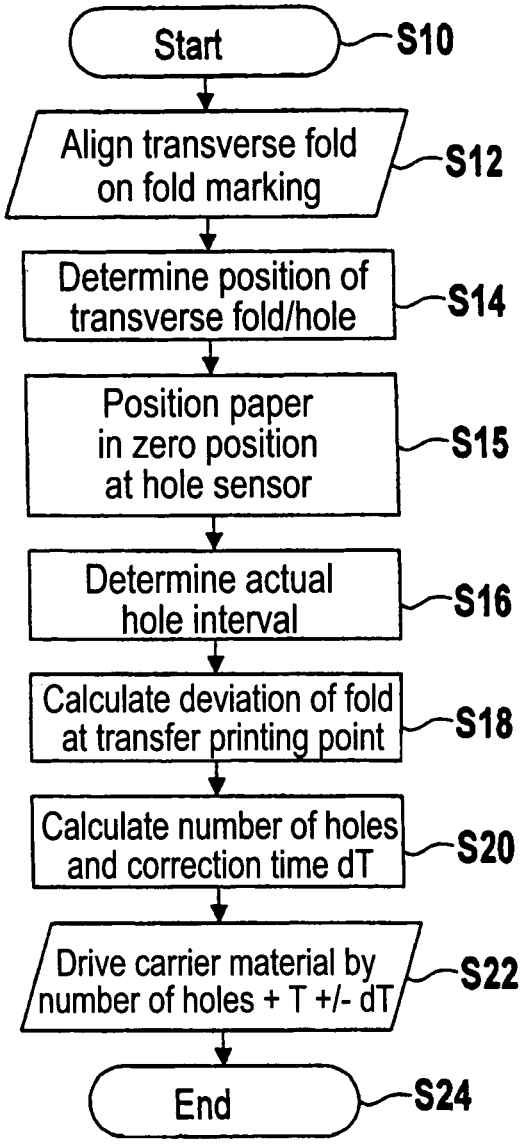
FIG. 12 is a workflow plan for determination and alignment of the position of a transverse fold present in the carrier material in proximity to a transfer printing point of the printer according to FIG. 1, which transverse fold is present at a desired position according to a first embodiment.

A workflow plan for exact positioning of a transverse fold at a desired position 166 8 inches before the transfer printing point 142 according to FIG. 11 is shown in FIG. 12 according to a first embodiment. In this first embodiment only the hole sensor 138 is provided. In this embodiment the hole sensor 140 is not used for positioning of the paper web 10 or is not present in the printer. The workflow is started in a step S10. In a step S12 an operating personnel subsequently aligns the transverse fold on the straight edge 136 (serving as a fold marking) by moving the paper web 10 forward and/or back. The position of the transverse fold relative to the adjustment margin holes is subsequently determined with the aid of the sensor arrangement 100, as already described in connection with FIGS. 3 through 6. A more detailed workflow for determination of the position of the transverse fold relative to the adjacent margin holes is subsequently described in detail in connection with FIG. 13.

After the position of the transverse fold relative to the magnetic field has been determined in step S14, the paper web 10 is transported until the next margin hole is conveyed into the region of the hole sensor 138. With the aid of a hole edge of the margin hole, the hole sensor 138 determines a zero position of the paper web 10, whereby the positions of all further margin holes start from this determined hole edge. The position of every further transverse fold can be determined in the printer by the control unit ST with the aid of the position (determined previously in step S14) of the transverse fold aligned on the straight edge 136. The hole edge thus establishes a zero position of the paper web 10 from which all further positions can be determined. The adjustment of the further positions occurs via transport of a determined number of holes and, in the event that the desired position 166 has not reached a hole edge, via the further transport for a specific transport time with predetermined speeds after reaching the hole edge.

In step S16 the paper web 10 is subsequently transported forward by a preset number (for example 79) of margin holes, whereby the required transport time is determined, whereby the required transport time is determined.

The actual distance between these 79 margin holes is determined with the aid of the transport time at the known transport speed. The 79 margin holes correspond to a length of 1003.3 mm. Both the error of ±1 mm (described in connection with FIG. 3) due to an allowable tolerance of the paper web of ±2 mm at 2000 mm as well as at the same time the length influence of the printer on the paper web of ±1 mm should thereby be determined in order to be able to correspondingly take into account later positioning of the paper web 10 in the printer or of the transverse folds in the printer. Other transport lengths for determination of the error are possible, whereby the precision upon determination of the error decreases given shorter transport lengths and rises given longer transport lengths. Alternatively, the actual hole interval can also be determined in step S16 in a test run implemented beforehand with the paper web 10. The test run can thereby also be implemented with higher precision over a larger transport length. Furthermore it is also possible to continuously determine the deviation given transport during a printing process.

In step S18 the deviation of the transverse fold at the transfer printing point 142 is subsequently calculated. In a step S20 it is subsequently calculated how many margin holes and for what transport time the paper web 10 must be further conveyed after reaching the calculated number of margin holes. Thus the transport time for covering the interval between determined hole edge and the interval of the transverse fold to be positioned relative to this hole edge as well as from a correction time ΔT resulting due to the deviation calculated in a step S18 are determined.

In a step S22 the paper web 10 is transported by the holes determined in the step S20 and further for the determined time duration T, minus or plus the correction time ΔT, such that the transverse fold is positioned at the desired position 166 before the transfer printing point 142. In the printer shown in FIG. 11, this desired position 166 lies 8 inches before the transfer printing point 142. The subsequent transfer printing of a toner image from the transfer belt 19 starts from this desired position 166 and thus forms the initial position of the paper web 10.

Figure 13:
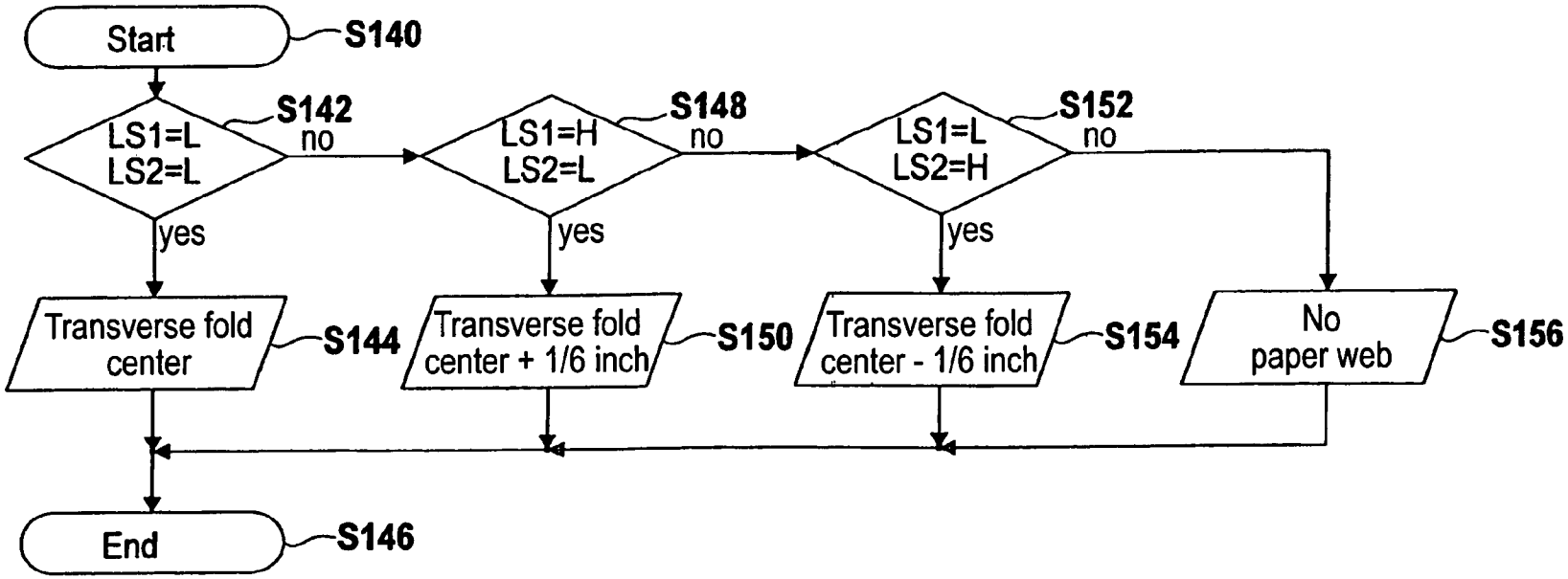
FIG. 13 is a workflow plan for determination of the position of the transverse fold relative to the margin hole in a step S14 according to FIG. 12.

A more detailed workflow regarding step S14 according to FIG. 12 for determination of the position of the transverse fold relative to the adjacent margin hole is shown in detail in FIG. 13. In a step S140 the workflow is started. In a step S142 it is subsequently determined whether both light barriers LS1 and LS2 output a first signal, namely a low signal. If this is the case, in a step S144 it is determined that the transverse fold lies in the middle between the two adjacent margin holes 76, 78. This position is stored in the control unit ST of the printer in order to subsequently be able to determine the positions of other transverse folds. The workflow is subsequently ended in a step S176.

However, if in a step S142 it is established that the light barriers LS1 and LS2 do not respectively output the first signal, in a step S148 it is subsequently checked whether the light barrier LS1 outputs a second signal and the light barrier LS2 outputs a first signal, whereby the second signal is a high signal. If this is the case, in a step S150 it is determined that the position of the transverse fold aligned on the straight edge 136 is displaced from the middle between the two margin holes by ⅙ of an inch in the direction of the margin hole 78. This position of the transverse fold is stored in a memory range of the control unit ST in order to subsequently calculate the positions of further transverse folds of the paper web 10. The workflow is subsequently ended in a step S146.

However, if it is established in a step S148 that the signal of the light barrier LS1 is not the second signal or that the signal output by the light barrier LS2 is not the first signal, in a step S152 it is subsequently checked whether the signal output by the light barrier LS1 is the first signal and the signal output by the light barrier LS2 is the second signal. If this is the case, in a step S154 it is subsequently determined that the transverse fold is displaced ⅙ of an inch in front of the center between the two margin holes 76 and 78 (and thus in the direction of the margin hole 76), whereby this position value is stored in a memory range of the memory unit ST. The workflow is subsequently ended in a step S146. However, if in a step 152 it is established that the light barrier LS1 does not output the first signal or that the light barrier LS2 does not output the second signal, in a step 156 it is subsequently determined that no paper web 10 is inserted into the printer. The workflow is subsequently ended in the step S156.

Figure 14:
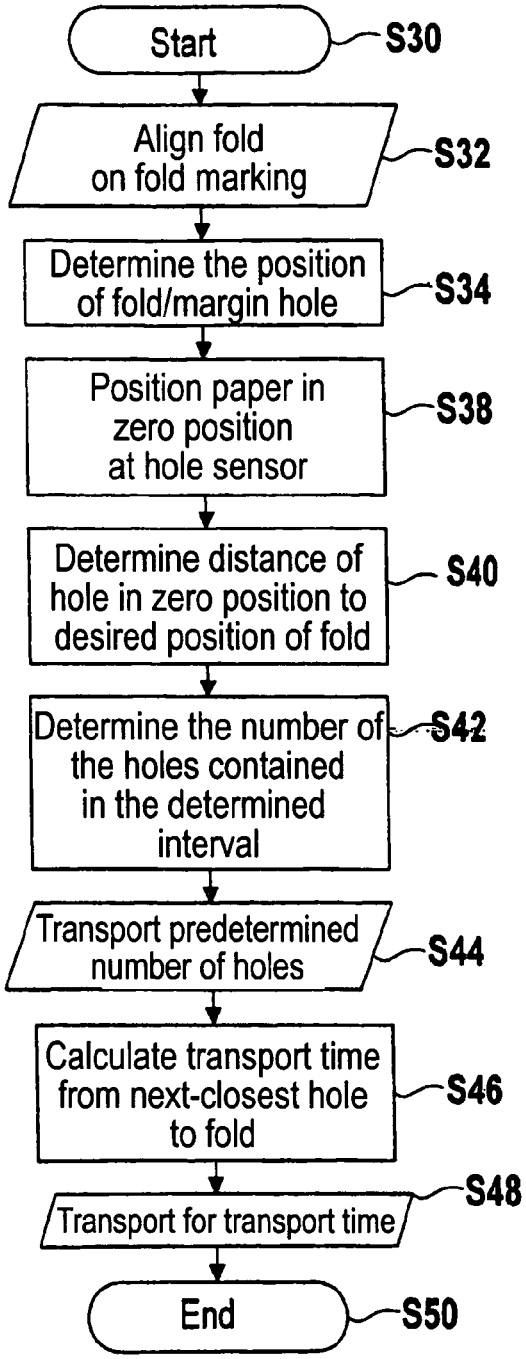
FIG. 14 is a workflow plan for exact positioning of a transverse fold at a desired position in proximity to the transfer printing point according to a second embodiment.

In FIG. 14 a workflow for exact positioning of a transverse fold at a desired position 166 8 inches before the transfer printing point 142 according to FIG. 11 is shown according to a second embodiment. In this second embodiment only the hole sensor 140 arranged in proximity to the transfer printing point 142 is used for positioning of the paper web 10. The hole sensor 138 according to FIG. 11 is not present in the printer or is not used for positioning of the paper web 10 in the workflow according to FIG. 14. The workflow is started in a step S30. In a step S32 the transverse fold is subsequently manually aligned by an operating personnel on the straight edge serving as a fold marking. In a step S34 the position of the transverse fold is subsequently determined relative to at least one adjacent margin hole (as described in connection with FIG. 13). The paper web 10 is subsequently transported in the printer until the hole sensor 140 arranged in proximity to the transfer printing point 142 determines the hole edge of the margin hole arriving next at this hole sensor 140. Upon arrival of the hole edge at the hole sensor 140, this position is established as a zero position from which the positions of the other margin holes and all transverse folds contained in the paper web 10 can be calculated based on the stored paper parameters.

In a step S40, the distance to be traveled until a desired transverse fold is arranged at the desired position 166 8 inches before the transfer printing point 142 is determined starting from the determined edge of the hole located at the zero position. This distance is dependent on, among other things, the form length (i.e. on the page length) and thus on the interval between two transverse folds.

In a step S42 the number of the margin holes contained in the interval determined in the step S40 is determined. In a step S44 the transport time for the distance from a margin hole adjacent to the next-closest transverse fold until the transverse fold is subsequently calculated, i.e. the time that the printer requires for transport of the paper web 10 in order to bring the transverse fold into the desired position after the margin hole immediately adjacent to the transport direction is positioned in proximity to the desired position 166 of the transverse fold.

In a step S46 the paper web 10 is then transported by the number of margin holes determined in step S42. The paper web 10 in a step S48 10 is also transported for the transport time determined in a step S44. The transport of the paper web 10 is advantageously not interrupted after the positioning of the next-closest margin hole in proximity to the desired position 166; rather it is conveyed further for the determined transport time. The workflow is ended in a step S50.

A paper web 10A is shown in FIG. 14 that can likewise be printed on the front side and back side simultaneously with the aid of the printer shown in FIG. 1. In contrast to the paper web 10, the endless paper web 10A comprises no region with margin holes. The paper web 10A has transverse folds 150, 152 arranged at a constant interval relative to one another, whereby the endless paper web 10A is transported through the printer in the direction of the arrow P2 for printing.

In a pre-processing stage, the paper web 10A is printed with position marks 154, 156 (what are known as synchronization marks). The position marks 154, 156 have a preset spacing relative to the transverse folds 150, 152 and thus a spacing relative to one another that corresponds to the page length between two transverse folds 154, 156.

Figure 16:
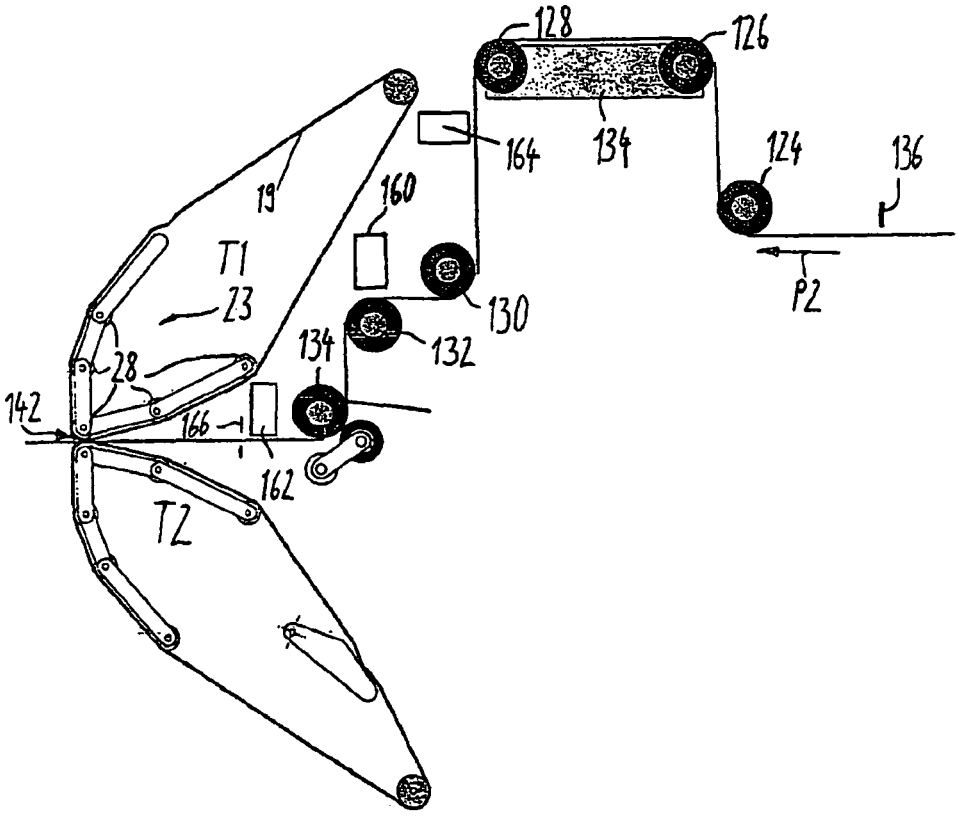
FIG. 16 shows the paper transport path of an endless carrier material through the printer according to FIG. 1, whereby elements for positioning of an endless carrier material according to FIG. 15 are shown.

The transport path of the paper web 10A through the printer is shown in FIG. 16. In addition to the hole sensors shown and described in FIG. 11, the printer according to FIG. 1 comprises what are known as mark sensors 160, 162 that detect the printed position marks 154, 156. As shown in FIG. 16, the printer according to FIG. 1 has a first position mark sensor 160 and a second position mark sensor 162. The mechanical arrangement of the printing groups and the rollers as well as of the tilt frame coincide with the arrangement shown in FIG. 11. Identical elements have the same reference characters. The edge sensor 164 serves for regulation of the lateral position of the paper web 10A, whereby (as already explained in connection with FIG. 11) a lateral position correction of the paper web 10A is implemented with the aid of the inclination of the tilt frame.

The position mark sensor 160 has essentially the same position as the hole sensor 138 according to FIG. 11. The interval between an edge of the position mark 154 (which position mark 154 is aligned transverse to the transport direction) relative to the transverse fold 150 is permanently preset in the printer. After the insertion of the paper web 10A in the printer, the paper web 10A is transported until the position mark sensor 116 detects the next position mark on the paper web 10A. This position is then the zero position from which the printer calculates all further positions of transverse folds 154, 156 and to-be-expected positions of position marks 150, 152. The second position mark sensor 162 is arranged in proximity to the transfer printing point 142 and there detects the exact position of the position mark 150, 152 in order to exactly determine the real position of the transverse fold 150 present in the paper web 10A at an interval relative to this position mark 150, 152. Starting from this real position, the paper web 10A is transported for a calculated transport time such that the transverse fold 150 is positioned exactly at the desired position 166 before the transfer printing point 142. The mark sensor 162 thus has essentially the same function in the positioning of the paper web 10A as the hole sensor 140 given positioning of the paper web 10. In other printers only the mark sensor 160 or only the mark sensor 162 is provided, whereby according to the preferred embodiment a first method for controlling the printer with the aid of the mark sensor 160 is provided in which the mark sensor 162 is not necessary, and a second method for controlling the printer with the aid of the mark sensor 162 is provided in which the mark sensor 160 is not necessary.

Figure 17:
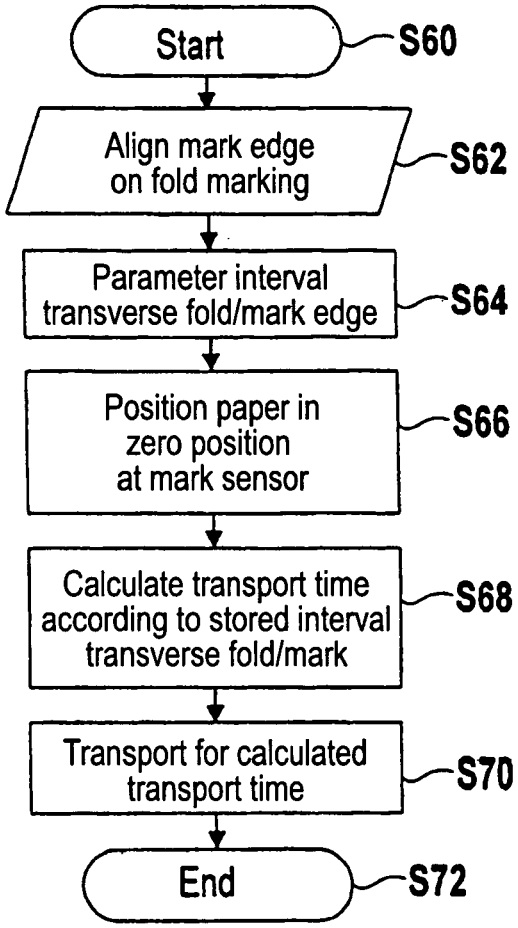
FIG. 17 is a workflow plan for positioning of a transverse fold contained in the carrier material according to FIG. 15, which transverse fold is positioned at a desired position in proximity to the transfer printing point of the printer according to FIG. 16 according to a first embodiment

A workflow for positioning of a transverse fold 150 in the paper web 10A according to FIG. 16 at a desired position 166 in proximity to the transfer printing point 142 according to a first embodiment is shown in FIG. 17. In this first embodiment only the mark sensor 162 is provided in the printer. In this embodiment the mark sensor 160 is not used for positioning of the paper web 10A in the workflow according to FIG. 17 or is not present in the printer. In a step S60 the workflow is started. In a step S62 the leading (viewed in the transport direction) mark edge is subsequently aligned on the straight edge serving as a fold marking, in that the operating personnel moves the paper web 10A forward and back in small steps via a button function on the control panel or with the aid of buttons provided on the printer.

In a step S64 a parameter stored for the paper web 10A is subsequently read out from a memory range of the control unit ST, which parameter contains the interval from a transverse fold 150, 152 to an adjacent edge of a position mark 154, 156. In a step S66 the paper web 10A is then positioned in the zero position at the mark sensor 162 as described in connection with FIG. 16.

The control unit ST of the printer can calculate the positions of all further transverse folds in the printer based on the determined zero position. The control unit ST thereby also calculates the real position of the transverse fold 150 (arranged before the subsequent page to be printed as viewed in the transport direction) in proximity to the transfer printing point 142. In a step S48 the control unit ST subsequently calculates the transport time from the real position of this transverse fold (based on the zero position) up to the desired position 166 of the transverse fold under consideration of the stored interval between position mark and transverse fold. In a step S70 the paper web 10A is conveyed for the calculated transport time. The workflow is subsequently ended in a step S72.

Figure 15:
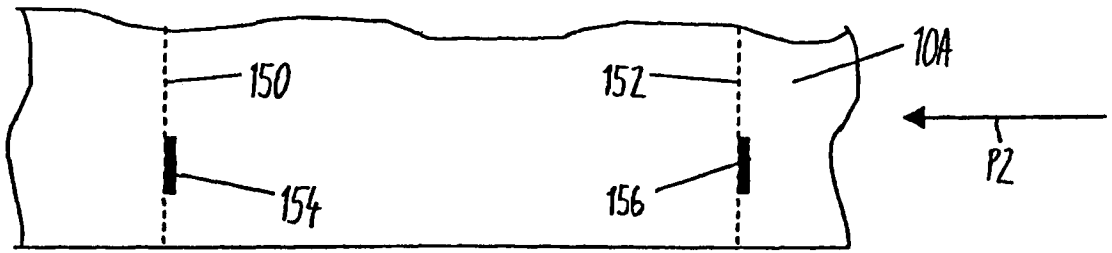
FIG. 15 is a section of an endless carrier material with transverse folds and position marks printed on the carrier material.
Figure 18:
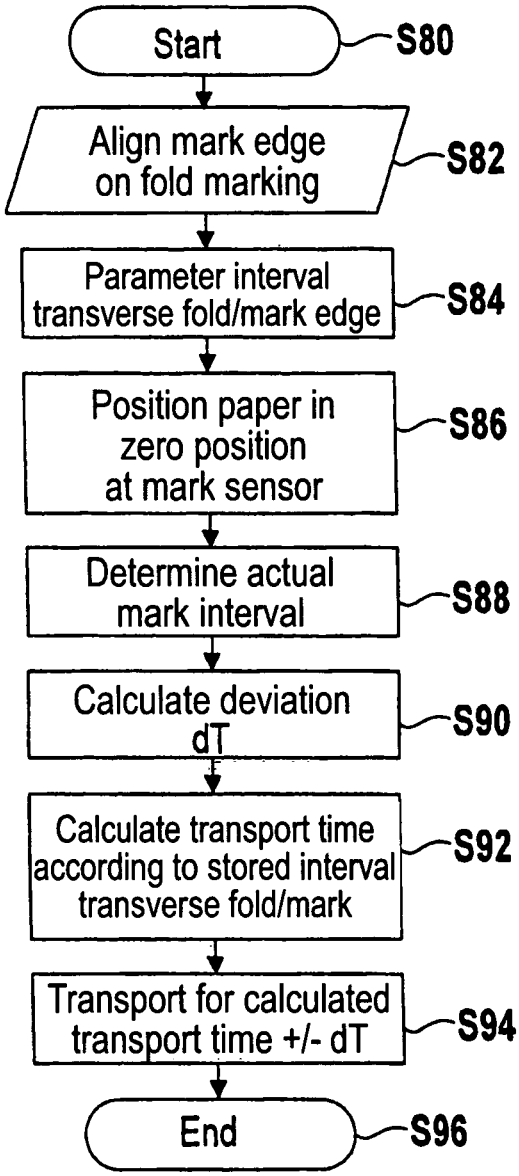
FIG. 18 is a workflow plan for positioning of a transverse fold contained in the carrier material according to FIG. 15, which transverse fold is positioned at a desired position in proximity to the transfer printing point of the printer according to FIG. 16 according to a second embodiment.

A workflow plan for positioning of a transverse fold (contained in a carrier material according to FIG. 15) at a desired position 166 in proximity to the transfer printing point 142 of the printer according to FIG. 16 according to a second embodiment is shown in FIG. 18. In this second embodiment only the mark sensor 160 is provided in the printer. In this embodiment the mark sensor 162 is not used for positioning of the paper web 10A in the workflow according to FIG. 18 or is not present in the printer. In a step S80 the workflow is started. In a step S62 the leading (viewed in the transport direction) mark edge is subsequently aligned on the straight edge serving as a fold marking. For this an operating personnel moves the paper web 10A forward and back in small steps via a button function on the control panel or with the aid of buttons provided on the printer.

In a step S84 a parameter stored for the paper web 10A is subsequently read out from a memory range of the control unit ST, which parameter contains the interval from a transverse fold 150, 152 to an adjacent edge of a position mark 154, 156. In a step S86 the paper web 10A is then positioned in the zero position at the mark sensor 160 as already described in connection with FIG. 16.

The control unit ST of the printer can calculate the positions of all further transverse folds 150, 152 in the printer based on the determined zero position. The control unit ST thereby also calculates the real position of the transverse fold 150 (arranged before the subsequent page to be printed as viewed in the transport direction) in proximity to the transfer printing point 142. In a step S88 the actual interval between two marks is subsequently determined with the aid of a short test run in which the paper web 10A is transported by, for example, 1 m in the primary transport direction P1 in order to determine the deviation of the actual mark spacing from a preset mark spacing. Such a test run is, for example, described in detail in connection with step S16 of FIG. 12.

Based on the determined length deviation, in a step S90 a time Δt is subsequently determined dependent on the transport speed of the printer, with which time Δt the position correction is implemented given the transport speed of the printer via shortening or extending the transport time.

In a step S92 the transport time that the paper web takes to reach the desired position 166 is subsequently calculated dependent on the spacing (stored as a parameter) between transverse fold and mark edge. In a step S94 the paper web 10A is subsequently transported for the calculated transport time ±Δt. The workflow is subsequently ended in a step S96.

Although a preferred exemplary embodiment is shown and described in detail in the drawings and the preceding specification, this should be viewed as purely exemplary and not as limiting the application. It is noted that only the preferred exemplary embodiment is shown and described, and all variations and modifications that presently and in the future lie within the protective scope of the invention should be protected.

We claim as our invention:

1. A method for aligning a transverse fold and adjacent adjustment page marks associated with a page on a web-shaped carrier material at a desired position before printing upstream of a transfer printing point where the printing occurs on said page following said transverse fold, said carrier material having a plurality of said transverse folds and associated page marks, and the carrier material being accelerated for said printing from a stop state when said transverse fold is at said desired position, comprising the steps of:

aligning one of the transverse folds with respect to a fold alignment member by moving said carrier material;

providing a first sensor arrangement and determining a position of the adjacent page marks relative to said transverse fold by use of said first sensor arrangement;

providing a second sensor arrangement downstream of the first sensor arrangement and upstream of said transfer printing point;

transporting the carrier material until a next arriving page mark is detected by said second sensor arrangement for determining a zero position of said carrier material so that positions of all further page marks start from this determined zero position and positions of all other transverse folds can be determined based on the transverse fold at the fold alignment member and stored carrier material parameters;

transporting the carrier material at a known transport speed by a preset number of page marks to determine a transport time and calculating an actual distance between adjacent page marks with aid of the transport time and said known transport speed;

calculating a deviation of a transverse fold at said transfer printing point;

calculating a number of page marks and for what transfer time the carrier material must be further conveyed;

transporting the carrier material by said calculated number of page marks so that said transverse fold is positioned at said desired position before said transfer printing point; and starting transfer printing on said carrier material by starting movement of the carrier material after said stop state when said transverse fold is positioned at said desired position.

2. The method of claim 1 wherein said adjacent page marks on the carrier material comprise holes on each side of said transverse fold in the carrier material.

3. The method of claim 1 wherein said page marks on the carrier material are printed marks previously printed on the carrier material adjacent to and lying on each side of the transverse fold.

4. The method of claim 1 wherein said fold alignment member comprises a straight edge.

5. A method for aligning a transverse fold and adjacent adjustment page marks associated with a page on a web-shaped carrier material at a desired position before printing upstream of a transfer printing point where the printing occurs on said page following said transverse fold, said carrier material having a plurality of said transverse folds and associated page marks, and the carrier material being accelerated for said printing from a stop state when said transverse fold is at said desired position, comprising the steps of:

aligning one of the transverse folds with respect to a fold alignment member by moving said carrier material;

providing a first sensor arrangement and determining a position of the adjacent page marks relative to said transverse fold by use of said first sensor arrangement;

providing a second sensor arrangement downstream of the first sensor arrangement and upstream of said transfer printing point;

transporting the carrier material until a next arriving page mark is detected by said second sensor arrangement for determining a zero position of said carrier material so that positions of all further page marks start from this determined zero position and positions of all other transverse folds can be determined based on the transverse fold at the fold alignment member and stored carrier material parameters;

determining a distance to be traveled until the transverse fold is arranged at said desired position starting from the determined page mark located at said zero position, said distance being dependent on page length and on an interval between two transverse folds;

determining a number of page marks contained in said interval between the two transverse folds;

determining a transport time for a distance from a page mark adjacent to a next-closest transverse fold to said transverse fold to be positioned at said desired position;

transporting the carrier material by said number of page marks contained in said interval between the two transverse folds;

transporting the carrier material for said determined transport time so as to position said transverse fold at said desired position; and starting transfer printing on said carrier material by starting movement of the carrier material after said stop state when said transverse fold is positioned at said desired position.

6. The method of claim 5 wherein said adjacent page marks on the carrier material comprise holes on each side of said transverse fold in the carrier material.

7. The method of claim 5 wherein said page marks on the carrier material are printed marks previously printed on the carrier material adjacent to and lying on each side of the transverse fold.

8. The method of claim 5 wherein said fold alignment member comprises a straight edge.

* * * * *